US007571844B2

(12) United States Patent
Bromley et al.

(10) Patent No.: US 7,571,844 B2
(45) Date of Patent: Aug. 11, 2009

(54) PNEUMATIC HAND TOOL FOR INSERTING T-NUTS

(75) Inventors: Keith G. Bromley, Sharon (CA); Sung Hsiang Liu, Scarborough (CA)

(73) Assignee: Sigma Tool & Machine, a Partnership between Sigma Tool & Machine Ltd. and Sigma Fasteners, Ltd., Toronto (CA)

( * ) Notice: Subject to any disclaimer, the term of this patent is extended or adjusted under 35 U.S.C. 154(b) by 65 days.

(21) Appl. No.: 11/339,682

(22) Filed: Jan. 26, 2006

(65) Prior Publication Data

US 2007/0170222 A1 Jul. 26, 2007

(51) Int. Cl.
*B25C 1/04* (2006.01)

(52) U.S. Cl. ..... 227/136; 227/130; 227/120; 227/127

(58) Field of Classification Search ..... 227/130, 227/136, 119, 120, 127, 129, 142, 121
See application file for complete search history.

(56) References Cited

U.S. PATENT DOCUMENTS 3,438,449 A 4/1969 Smith
3,460,217 A 8/1969 Leistner
3,480,061 A 11/1969 Leistner
3,658,229 A * 4/1972 Pomeroy ..... 227/10
3,964,659 A * 6/1976 Eiben et al. ..... 227/8
4,049,181 A * 9/1977 Kametaki ..... 227/113
4,251,017 A * 2/1981 Doyle et al. ..... 227/8
4,389,012 A * 6/1983 Grikis et al. ..... 227/120
4,463,888 A * 8/1984 Geist et al. ..... 227/109
4,558,811 A * 12/1985 Klaus ..... 227/116
4,809,900 A * 3/1989 Ingelsten et al. ..... 227/116
5,025,968 A * 6/1991 Nasiatka ..... 227/8
5,192,012 A 3/1993 Schafer et al.

(Continued)

FOREIGN PATENT DOCUMENTS

EP 0 894 578 A2 2/1999

(Continued)

OTHER PUBLICATIONS www.Sigmatool.com/t-nut-machines/handheld-t-nut-tool.html.

(Continued)

*Primary Examiner*—Brian D Nash
(74) *Attorney, Agent, or Firm*—Birch, Stewart, Kolasch & Birch, LLP

(57) ABSTRACT

A portable device for inserting fixing elements into predefined seats in a work piece, the portable device including a drive head; a drive rod extending downward from the drive head; a hollow nose piece slidably fit around a lower end of the drive rod, the nose piece being attached to the head and being movable vertically by a predetermined distance with respect to the head and the drive rod; a magazine mounted on the nose piece at a predetermined angle with respect to a lower face of the nose piece for feeding a first fixing element into a horizontal slot on the lower face the nose piece; and a single-blow drive mechanism providing a force produced by a pressurized fluid to an upper end of the drive rod when the drive mechanism is triggered. The force on the drive rod drives the first fixing element into the predefined seat in the work piece.

22 Claims, 19 Drawing Sheets

U.S. PATENT DOCUMENTS

| | | | | | |
|---|---|---|---|---|---|
| 5,231,750 | A * | 8/1993 | Fealey | 29/432 |
| 5,385,286 | A * | 1/1995 | Johnson, Jr. | 227/8 |
| 5,484,094 | A * | 1/1996 | Gupta | 227/8 |
| 5,579,975 | A * | 12/1996 | Moorman | 227/8 |
| 5,803,338 | A | 9/1998 | Singer et al. | |
| 5,842,625 | A * | 12/1998 | Kimura | 227/127 |
| 6,041,992 | A | 3/2000 | Poinelli et al. | |
| 6,199,739 | B1 | 3/2001 | Mukoyama et al. | |
| 6,422,447 | B1 * | 7/2002 | White et al. | 227/120 |
| D462,589 | S | 9/2002 | Nolan et al. | |
| 6,443,348 | B2 | 9/2002 | Lamb | |
| 6,708,861 | B2 * | 3/2004 | Osuga et al. | 227/120 |
| 6,761,299 | B2 | 7/2004 | Caringella et al. | |
| 2004/0188490 | A1 | 9/2004 | Losada | |
| 2007/0114259 | A1 * | 5/2007 | Bromley et al. | 227/120 |

FOREIGN PATENT DOCUMENTS

| | | | |
|---|---|---|---|
| WO | WO-2006/066589 | A2 | 6/2006 |

OTHER PUBLICATIONS

Stanley Bostitch, www.bostitch.com, PN100K-Industrial Impact Nailer Kit.
Sigma Tool & Machine, Sigma Hand Held T-Nut Tool.
Pneu Tools, Rap-A-Nail 150, Collated Joist Hanger Nailer.

* cited by examiner

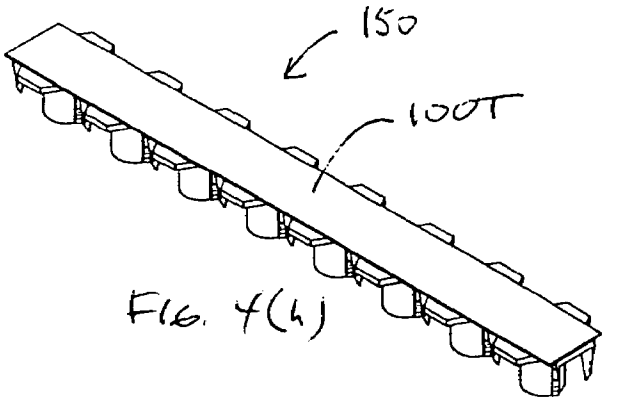
FIG. 4(h)
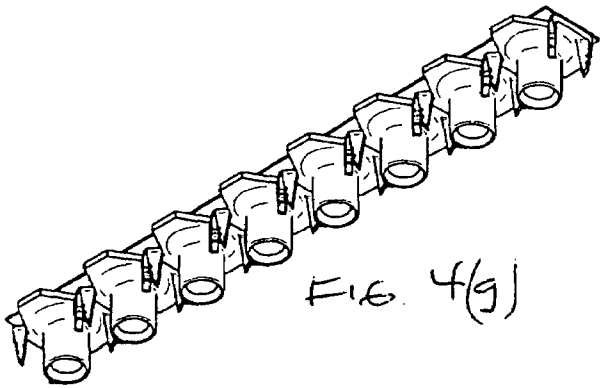
FIG. 4(g)
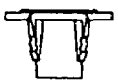
FIG. 4(f)
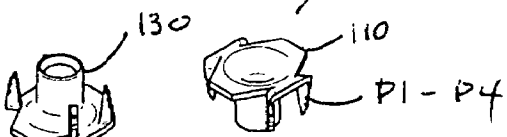
FIG. 4(a)
FIG. 4(b)
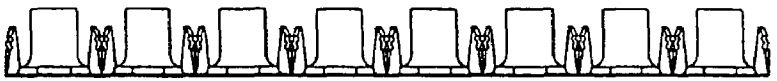
FIG. 4(c)
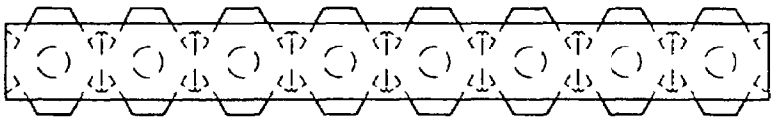
FIG. 4(d)
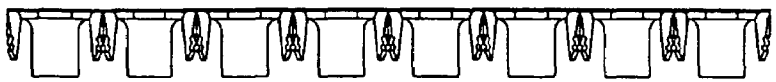
FIG. 4(e)

SECTION A-A 6E-6E

SECTION B-B 6F-6F 6E
6F
B
A
50
50a
50b
50c
50d
50e
50f
52
52a
52b
52c
52d
52e
52f
53
53a
54
55
56
56a
56b
57

PNEUMATIC HAND TOOL FOR INSERTING T-NUTS

BACKGROUND OF THE INVENTION

1. Field of the Invention

The present invention relates to a single-blow pneumatic hand tool for inserting t-nuts, and in particular to a pneumatic hand tool for inserting t-nuts having prongs.

2. Description of Background Art

The first commonly available t-nuts were stamped fasteners with a hollow shaft with an internal thread and a flange without prongs. These t-nuts had holes in the flange (usually three) that could accept small nails that would be used to hold the t-nut to the work piece. Later (late 1930's or early 1940's) t-nuts were introduced with prongs that were formed from the flange. These t-nuts would be located over the hole in a work piece and driven into the work piece with a hammer.

In the late 1960s, an "auto-sta" octagonal flange 4-prong t-nut, designed to feed in a track of a machine, and a t-nut machine to drive these t-nuts into the work piece, was developed. Today while a significant percentage of t-nuts are inserted using machinery, a substantial market remains where t-nuts are driven into a work piece by hand using a hammer. Specific areas where t-nuts are inserted with a hammer are:

Small Volume User: Traditional t-nut machines are generally only cost effective when the volume of t-nuts exceeds 50,000, for example.

Assembly Line Insertion: Some companies believe it to be more cost effective to insert t-nuts on the line while the frame is being assembled.

T-nuts in Large Work Pieces: Large work pieces are difficult to handle. In modern furniture production, frames are typically cut from large plywood sheets. When the components are large they can be too big and awkward to manipulate into a t-nut insertion machine.

Work Pieces with Blind Holes: In some applications t-nuts are inserted in a blind hole, such as when used to mount a leveler on a chair leg.

More recently, a pneumatically operated hand tool for inserting t-nuts has been introduced. This device has a magazine that accepts t-nuts that are collated into strips with a flexible adhesive tape, and uses a pneumatic stapler body with a reversed action. When the tool is at rest, the driver is fully extended in the down position and the tip of the driver sticks out the bottom of the nose piece. To operate the tool, the tip of the driver is first placed in the hole. Pressing down on the tool then releases the trigger safety. Squeezing the trigger initiates the following sequence: (1) The driver retracts, a t-nut is advanced into the nose of the tool by a feeder mounted on the magazine; and (2) When the trigger is released, the driver descends, driving the t-nut into the work piece.

While the concept of this pneumatically operated hand tool provides some improvement, the tool disclosed therein requires a careful technique during use to ensure that the t-nut is set into the hole properly. A problem often occurs because the driver is used to locate the hole, and squeezing of the trigger retracts the driver. The recoil of that action often causes the tool to move slightly. As a result, the t-nut is very often driven into the side of the hole, making it very difficult to start a screw in the t-nut. By holding the tool a certain way, it is possible to compensate for the recoil and to drive t-nuts properly, but for many users and environments it has never worked satisfactorily. A further problem with conventional single-blow (single-shot) hand tools is that they typically require a secondary safety to prevent injury. Even with a secondary safety, conventional single-blow hand tools cannot completely eliminate the risk of injury to the operator.

To address the problem of risk of injury to operators of single-blow hand tools, multi-blow hand tools have been proposed. While multi-blow hand tools may address the problem of injury associated with single-blow hand tools, they are slower to operate than single-blow tools.

An advantage of the single-blow hand tool is one of speed, particularly in the case where the user of the hand tool is inserting a large number of fasteners. The drive cycle with a single-blow tool is practically instantaneous compared with the 1 to 2 seconds that may be required with the multi-blow hand tool. Also when used continuously in a high volume application, the constant vibration of the multi-blow hand tool compared to the single-blow hand tool would lead to operator preference for the single-blow tool.

On the other hand, the pneumatic motor on the single-blow tool is larger, more powerful and more complex than that used on the multi-blow tool, and for this reason generally is more costly to manufacture. However, for a high volume user, the additional cost will not likely present an obstacle.

Thus, a need exists for a hand tool that is both fast and safe. The present invention was developed to address the problems of the conventional art including the problems described above.

SUMMARY OF THE INVENTION

According to one feature consistent with some embodiments of the present invention, a portable device for inserting fixing elements into predefined seats in a work piece is provided. The portable device including a drive head; a drive rod extending downward from the drive head; a hollow nose piece slidably fit around a lower end of the drive rod, the nose piece being attached to the head and being movable vertically by a predetermined distance with respect to the head and the drive rod; a magazine mounted on the nose piece at a predetermined angle with respect to a lower face of the nose piece for feeding a first fixing element into a horizontal slot on the lower face the nose piece; and a single-blow drive mechanism providing a force produced by a pressurized fluid to an upper end of the drive rod. The force on the drive rod drives the first fixing element into the predefined seat in the work piece.

According to another feature consistent with some embodiments of the present invention, the slot of the nose piece is arranged such that the first fixing element is disposed under a lower face of the drive rod and such that a part of the fixing element in the slot projects below the lower face of the nose piece, the projecting part of the first fixing element for locating one of the predefined seats into which the first fixing element is to be inserted.

According to still another feature consistent with some embodiments of the present invention a method for determining multiple predefined seat locations in a work piece and inserting fixing elements into the seats is provided. The method includes the steps of automatically transferring a first fixing element into a nose piece of a pneumatic hand tool, a barrel tip of the fixing element extending below a lower face of the nose piece, moving the nose piece over the work piece until the barrel tip of the first fixing element meets a first predefined seat; inserting the first fixing element into the first seat by applying pressure on the nose piece and triggering a pneumatic drive mechanism; automatically transferring a second fixing element from the magazine into the nose piece, a barrel tip of the second fixing element extending below the lower face of the nose piece; moving the nose piece over the work piece until the barrel tip of the second fixing element meets a second predefined seat; inserting the second fixing element into the second seat by applying the pressure on the nose piece and triggering the pneumatic drive mechanism; and repeating the steps above until the multiple predefined seat locations are found and filled with the fixing elements.

Further scope of applicability of the present invention will become apparent from the detailed description given hereinafter. However, it should be understood that the detailed description and specific examples, while indicating exemplary embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 4(*a*) to 4(*h*) illustrate views of an exemplary individual t-nut and a t-nut strip;

DETAILED DESCRIPTION

Figure 1:
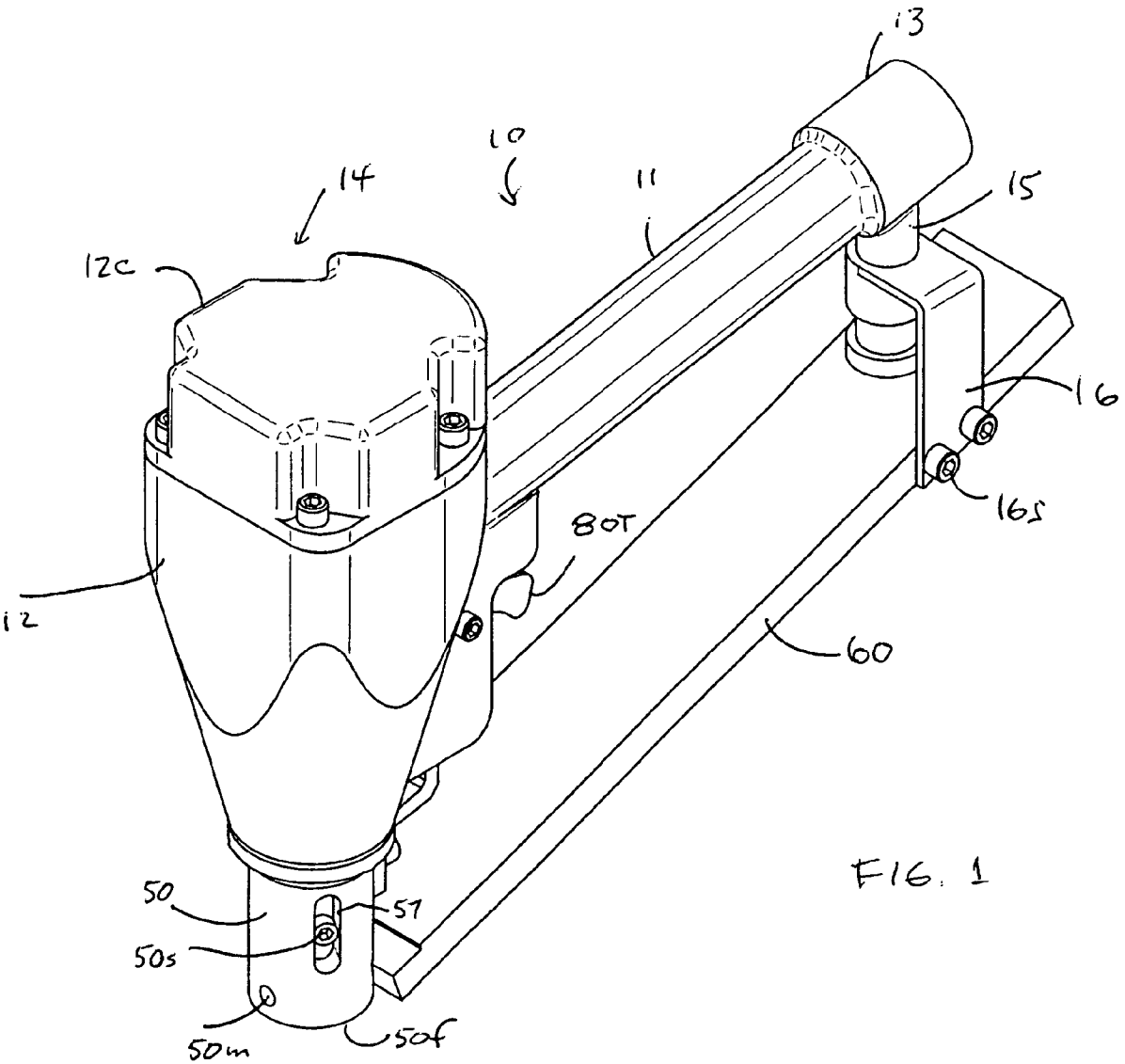
FIG. 1 is a line drawing of a pneumatic hand tool consistent with some embodiments of the present invention.
Figure 2:
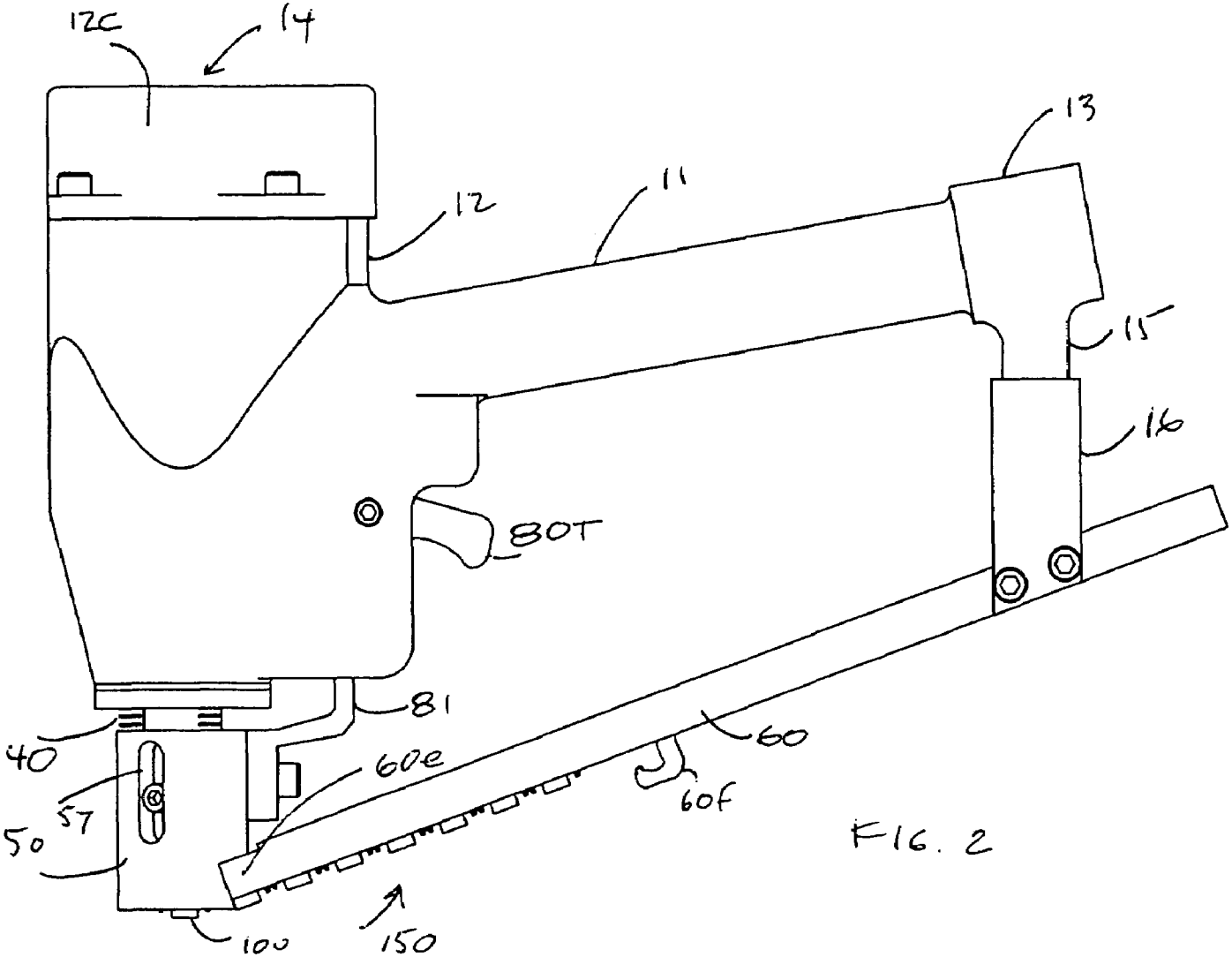
FIG. 2 is a profile view of the pneumatic hand tool showing a finger hook of the magazine follower consistent with some embodiments of the present invention.
Figure 3:
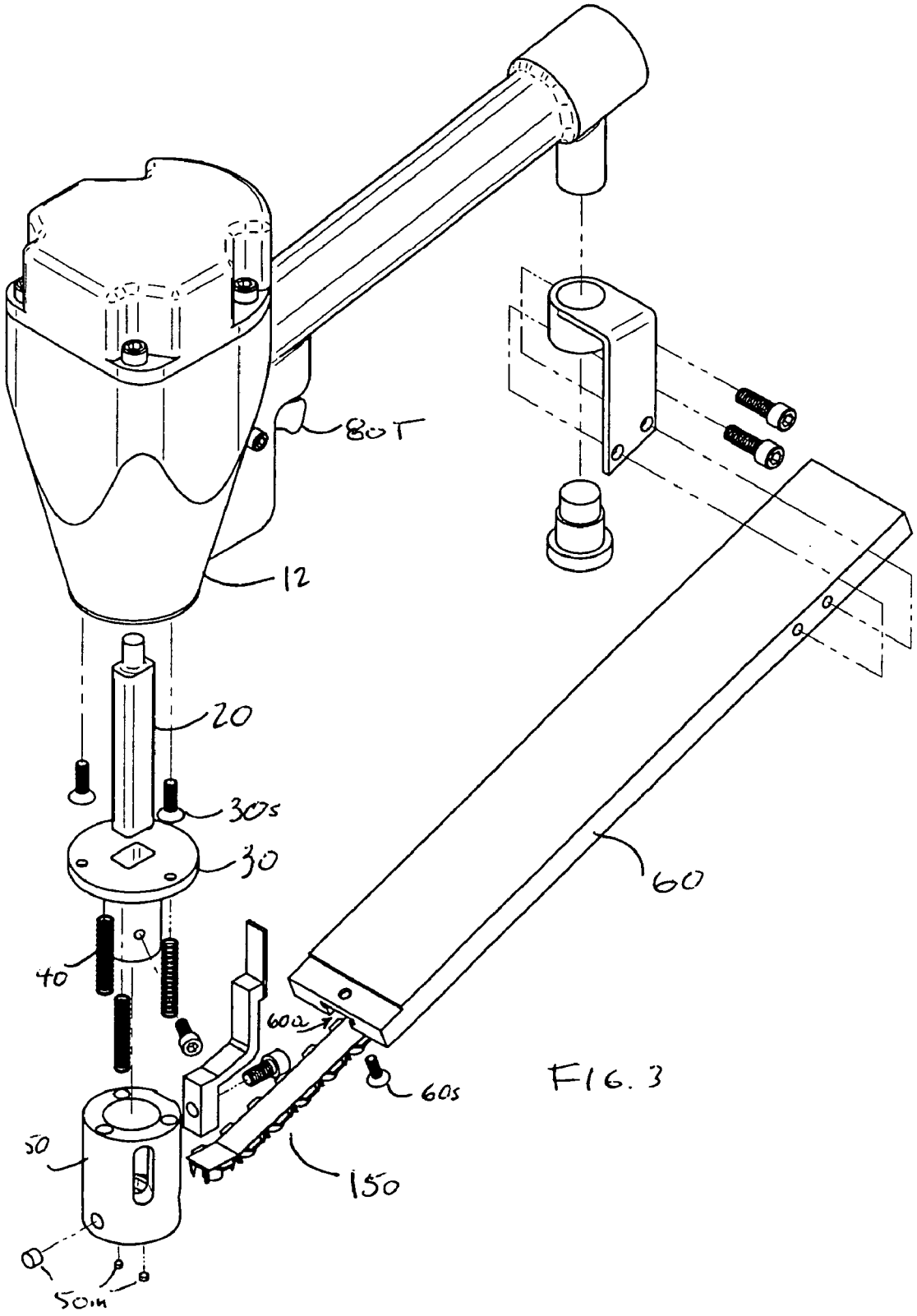
FIG. 3 is an exploded drawing of nose and driver assembly of hand tool of the embodiment.

The pneumatic hand tool for inserting t-nuts consistent with some embodiments of the present invention of the present invention is described with reference to FIGS. 1-3.

As can be seen, the pneumatic hand tool 10 for inserting t-nuts 100 has a nose piece and magazine combination (nose piece 50, angled magazine 60), the combination being slidingly attached to a pneumatic drive head 12 and a butt 13 of the casing 14 of the pneumatic hand tool 10. The magazine and nose piece combination and pneumatic drive head 12 are described below.

Magazine holding bracket 16 is slidably mounted on shaft 15 that extends downward from butt end 13 of the handle 11. Magazine holding bracket 16 is also fastened to the magazine 60 by fasteners 16*s*. Since a front end 60*e* of the magazine 60 is rigidly attached to the nose piece 50 and a rear end of the magazine 60 is attached to bracket 16, the magazine 60 moves up and down together with movement of the nose piece 50. The magazine 60 has a slot 60*a* for receiving a strip 150 of collated t-nuts 100 and a spring-loaded follower (not shown) that presses the strip 150 towards the nose piece 50, advancing one of the t-nuts 100 in the strip 150 into the nose piece 50 after every insertion. In FIG. 2, the follower (not shown) includes a finger hook 60*f* that is used to pull the follower back against the force of the magazine spring during the process of loading a strip 150 of multiple t-nuts 100. When pushed from the magazine 60 into the nose piece 50, the orientation of the t-nut 100 changes from an angle in the range of 20° to 45° with respect to horizontal. A magnet 50*m* positioned in the front of the nose piece 50 draws the t-nut 100 into a horizontal position in the nose piece 50.

The pneumatic drive head 12 of the present invention is a single-blow drive head. On the pneumatic hand tool 10 of the present invention, the drive head 12 may feature a cap 12*c* and an ergonomic handle 11 for user convenience and ease of use. The pneumatic hand tool 10 of the present invention uses a long drive rod 20. As can be seen in FIG. 3, the drive rod 20 may have a cross-section that is substantially rectangular in shape. Alternatively, the drive rod 20 may have a circular cross-section or a cross-section of another shape (not shown).

FIGS. 4(*a*) to 4(*h*) provide views of an exemplary individual t-nut 100 and a t-nut strip 150. FIGS. 4(*a*) and 4(*b*) shown perspective views on an individual t-nut 100. As can be seen, the t-nut 100 includes a barrel 130, flange 110 and multiple prongs P1 to P4. FIGS. 4(*c*) to 4(*h*) show a strip 150 of t-nuts 100 collated and held in place by a strip of tape 100T. FIGS. 4(*c*) and 4(*e*) are side views, FIG. 4(*d*) is a plan view, FIG. 4(*f*) is an end view, and FIGS. 4(*g*) and (*h*) are perspective views of the strip 150 of t-nuts 100. The pneumatic hand tool of the present invention may accommodate t-nuts having various base sizes, for example, a small base: 0.625"×0.700", a large base: 0.830"×0.885", or other sizes smaller or greater than these.

The tape 100T is formed with adhesive on the side applied to the bottom of the t-nuts 100. Any commonly known material may be used for the adhesive tape 100T. Once the t-nuts 100 are collated into a strip 150, the strip 150 is ready to be inserted into the magazine 60.

In the pneumatic hand tool 10, the magazine/nose piece combination is attached to the drive head 12 in such a way that the magazine 60 and nose piece 50 may slide up and down along an extension tube 30 which is mounted by screws 30*s* on the bottom of the drive head 12. A mechanism prevents the nose piece/magazine from falling off the extension tube 30. In some embodiments, the mechanism may include a vertical slot 57 machined into a side of the nose piece 50 through which a screw 50*s* is fastened to the extension tube 30. The nose piece 50 is able to slide up and down the extension tube 30 only over the length of the slot 57. One or more springs 40 may be fitted between the nose piece 50 and the drive head 12, in order to bias the nose piece 50 away from the drive head 12.

Figure 5C:
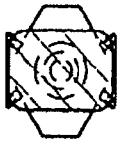
FIGS. 5(*a*) to 5(*c*) illustrate a perspective view, a side view, and a sectional view of the drive rod of the hand tool consistent with some embodiments of the present invention.
Figure 5B:
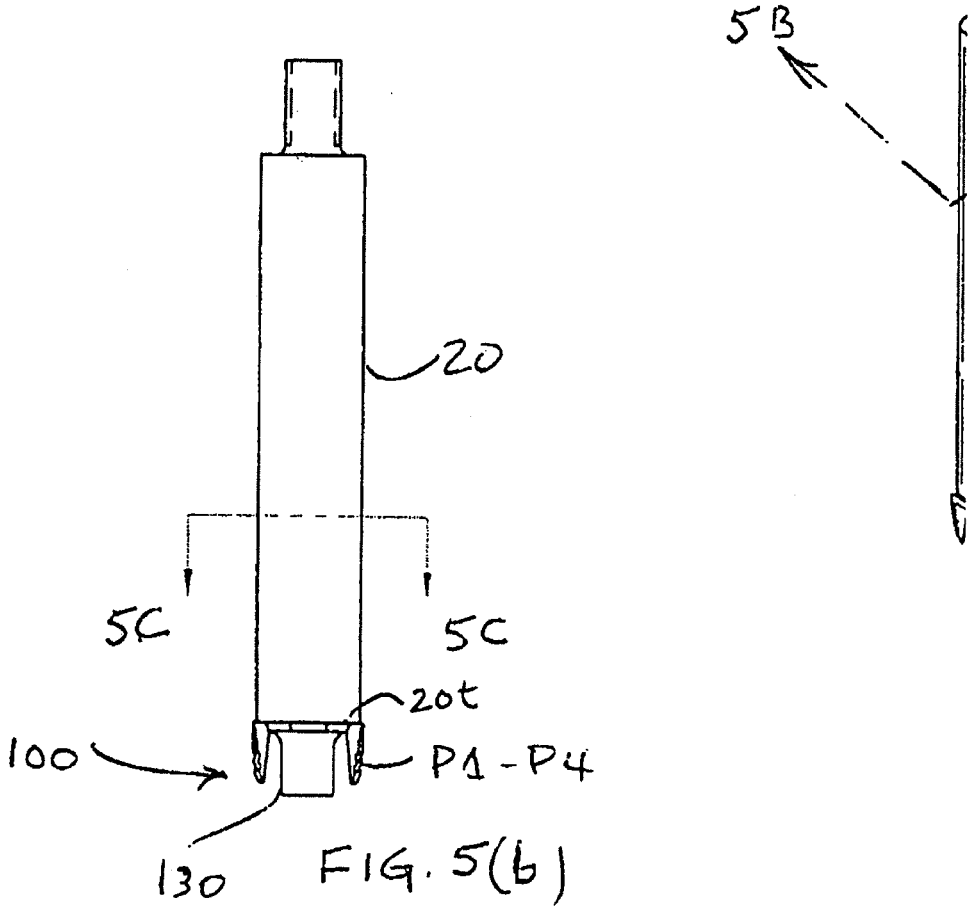

FIG. 5(*a*) illustrates a perspective view of an exemplary the drive rod 20 of the pneumatic hand tool 10. Tip end 20*t* presses against the t-nuts 100 when driving the t-nuts. FIG. 5(*b*) is a side view of the drive rod 20 as viewed in the direction of arrows 5B in FIG. 5(*a*), and FIG. 5(*c*) is a sectional view of the drive rod as viewed in the direction of arrows 5C in FIG. 5(*b*).

In order to insert a t-nut 100 in a single blow, the single-blow hand tool has a stroke length of ½" to 1", depending on the height of the t-nut, and delivers significantly more power than is typically required in a multi-blow hand tool. The longer stroke and added power, however, increase the risk of injury to the operator of the tool. In order to address this risk, the single-blow hand tool 10 includes a trigger safety mechanism 80 that includes a safety actuator 81 mounted on the nose piece 50.

Figures 6A, 6B, 6C, 6D, 6E, 6F:
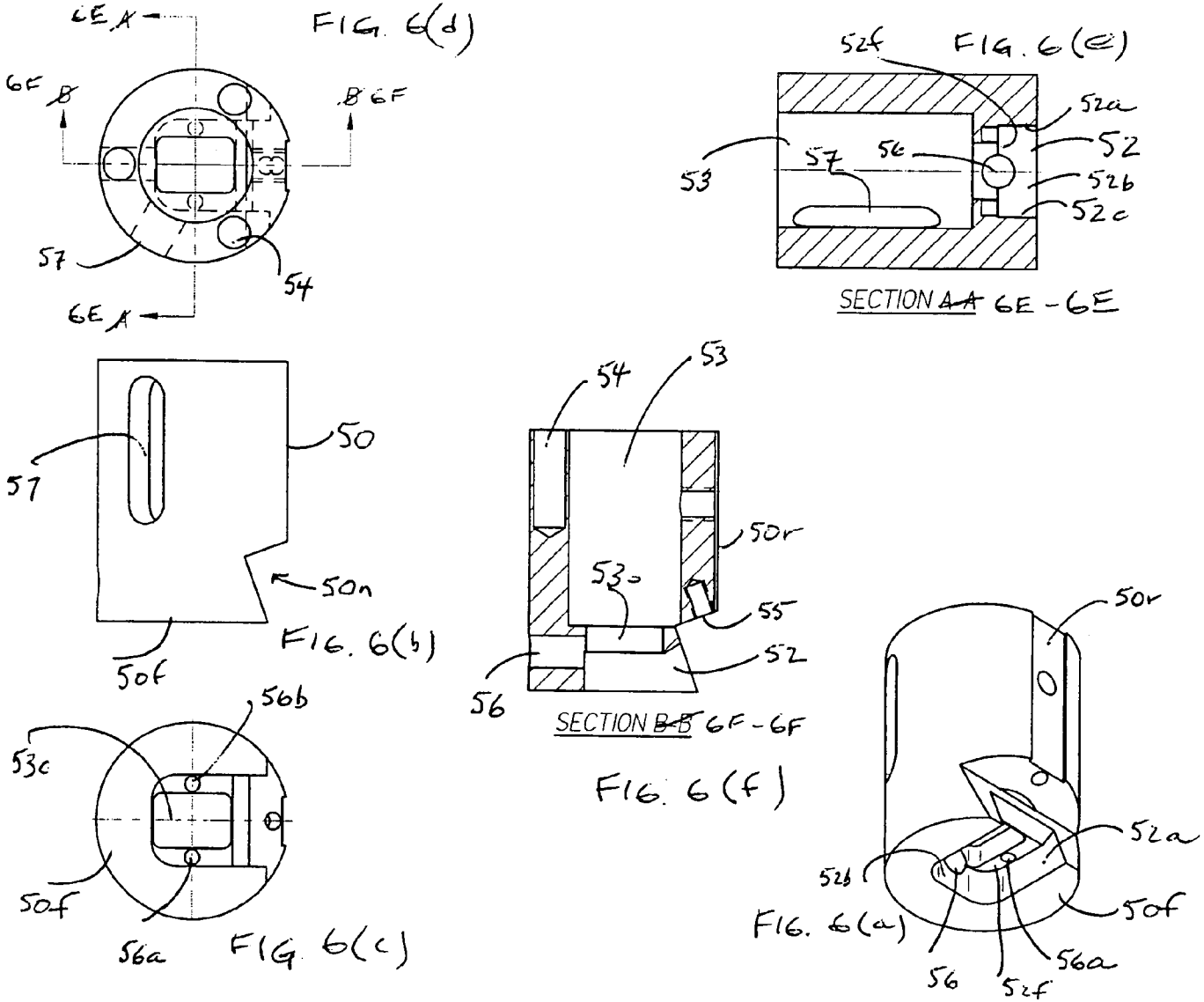
FIGS. 6(*a*) to 6(*f*) are additional views of a nose piece consistent with some embodiments of the present invention, and FIGS. 6(*g*) and 6(*h*) illustrate one embodiment of a safety actuator.
Figure 6H:
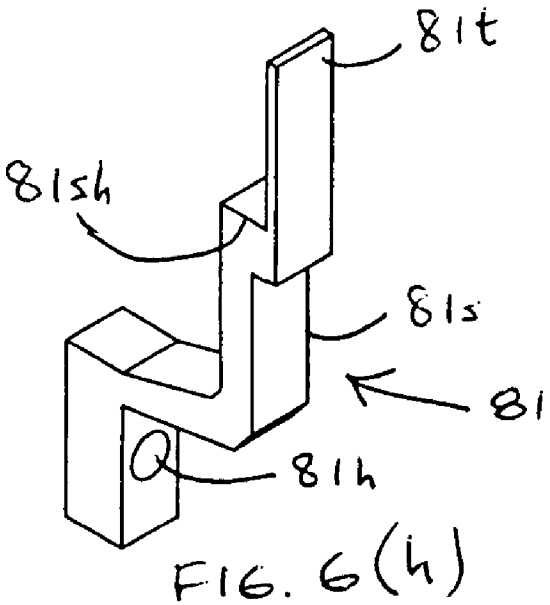
Figure 6G:
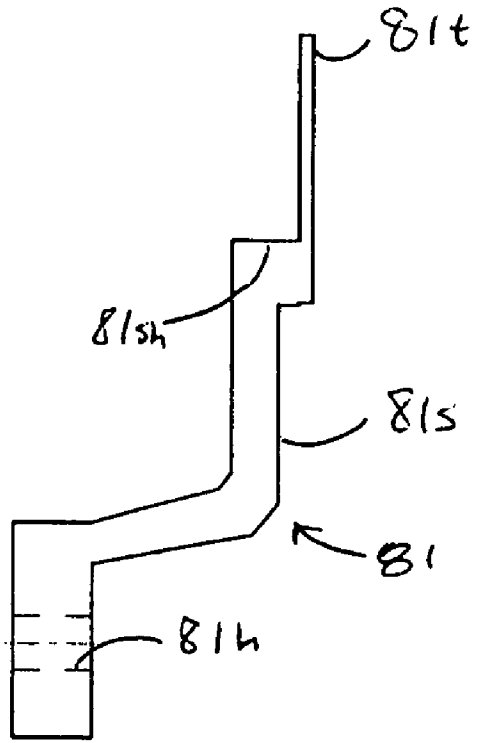
Figure 7B:
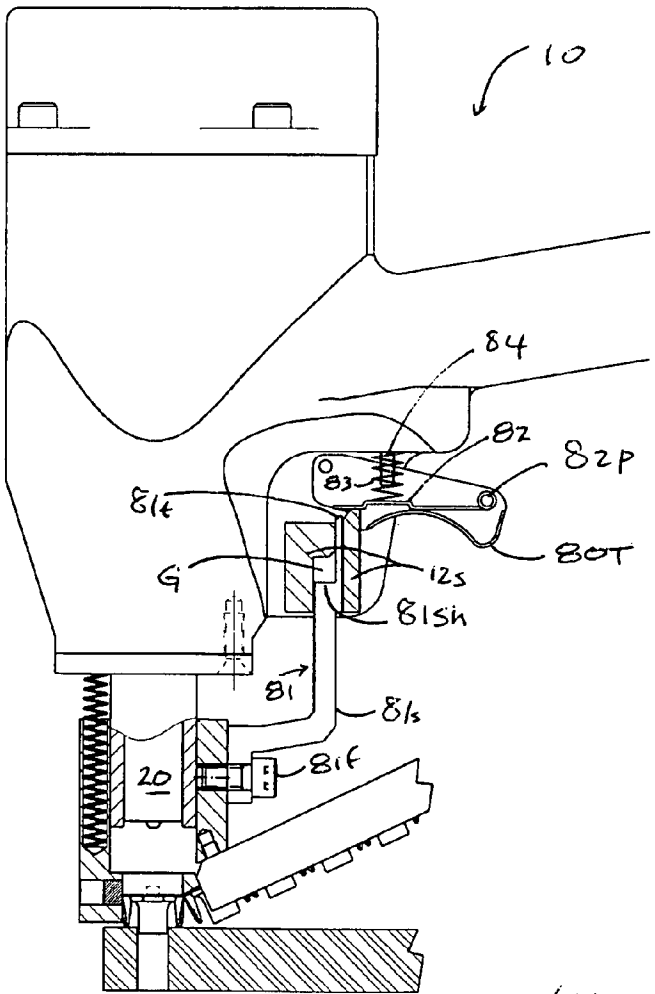
FIGS. 7(*a*) to 7(*e*) are cut-away views showing an exemplary sequence of locating a hole and inserting a t-nut with a nose piece assembly equipped with a safety actuator consistent with some embodiments of the present invention, and FIGS. 7(*f*) and 7(*g*) illustrate an operation of the safety actuator.
Figure 7A:
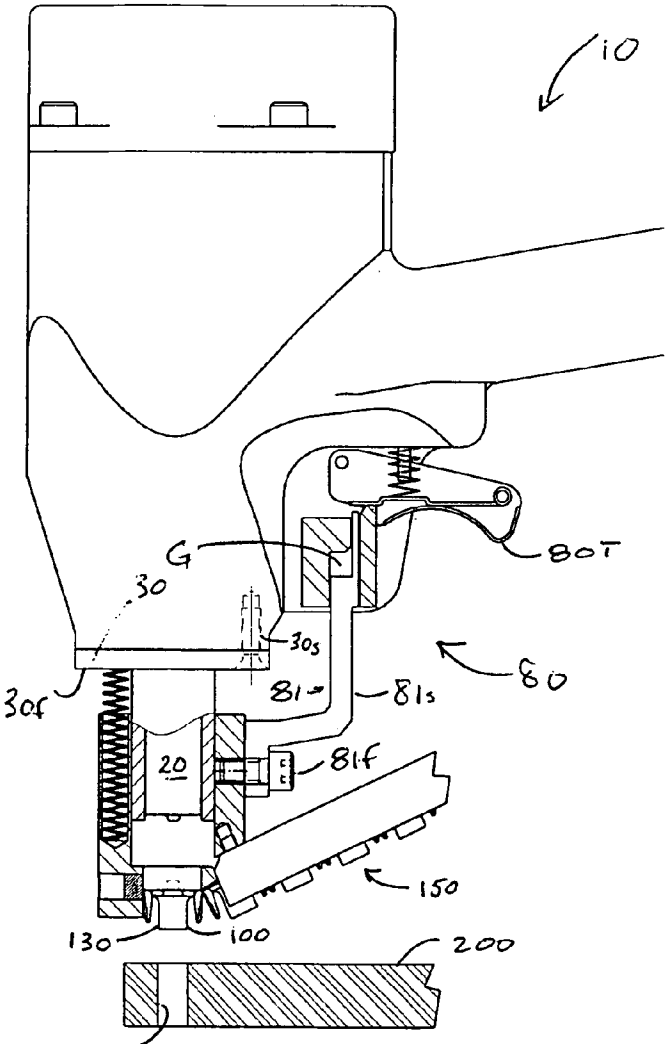
Figure 7D:
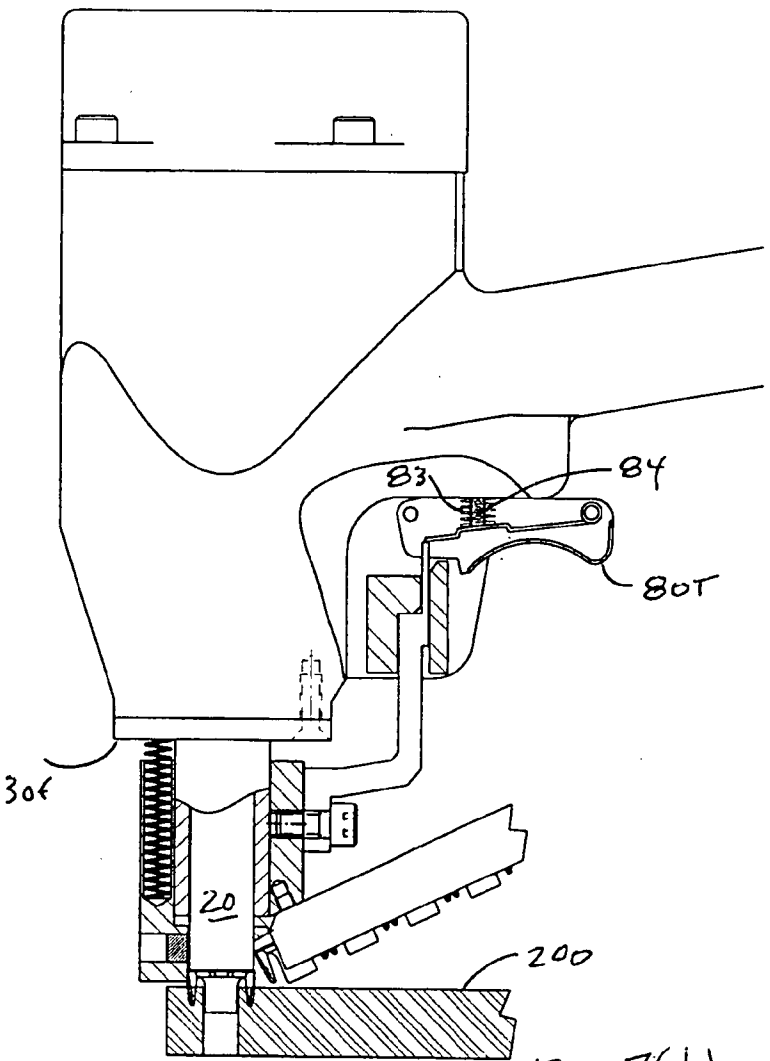
Figure 7C:
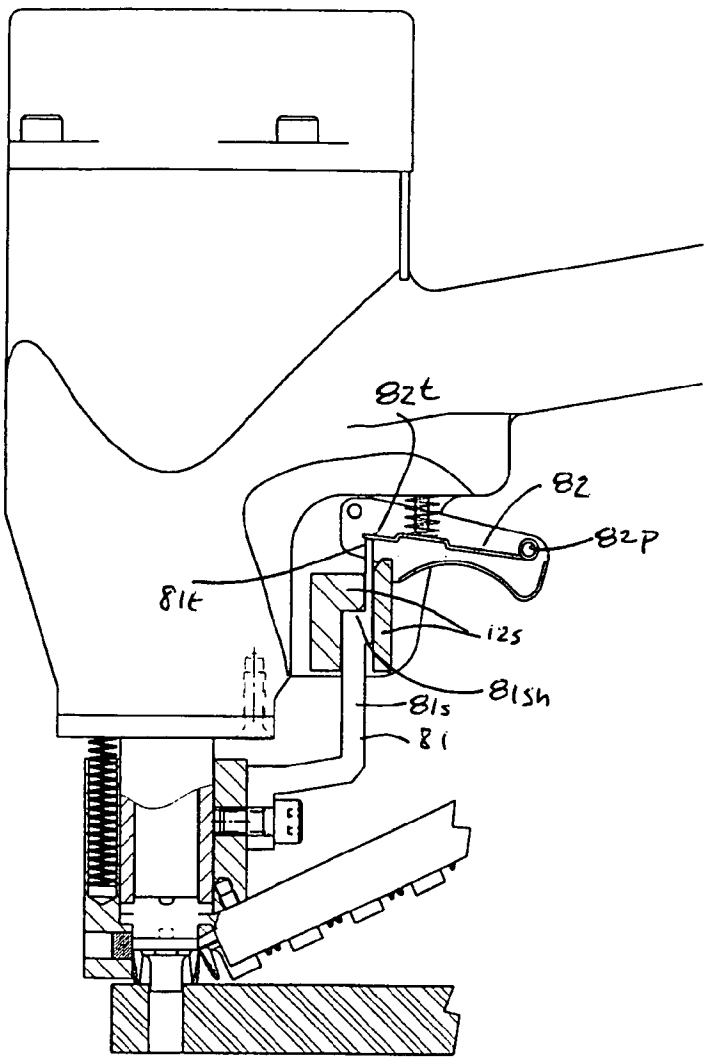
Figure 7E:
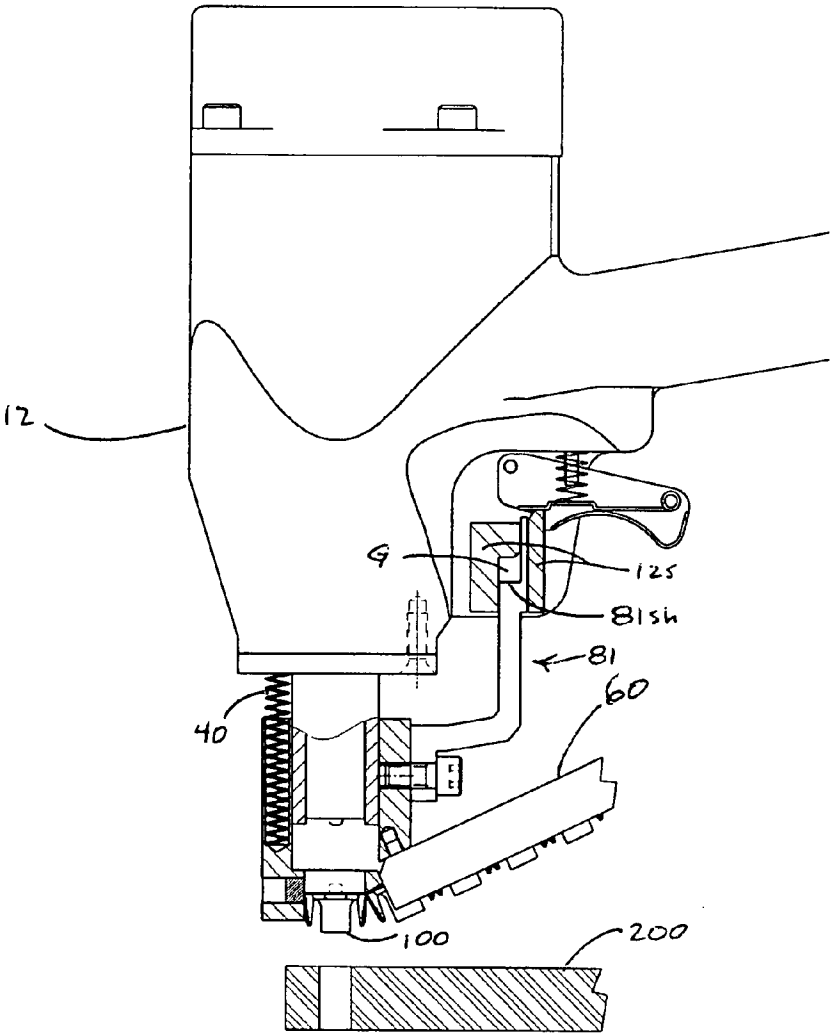
Figure 7G:
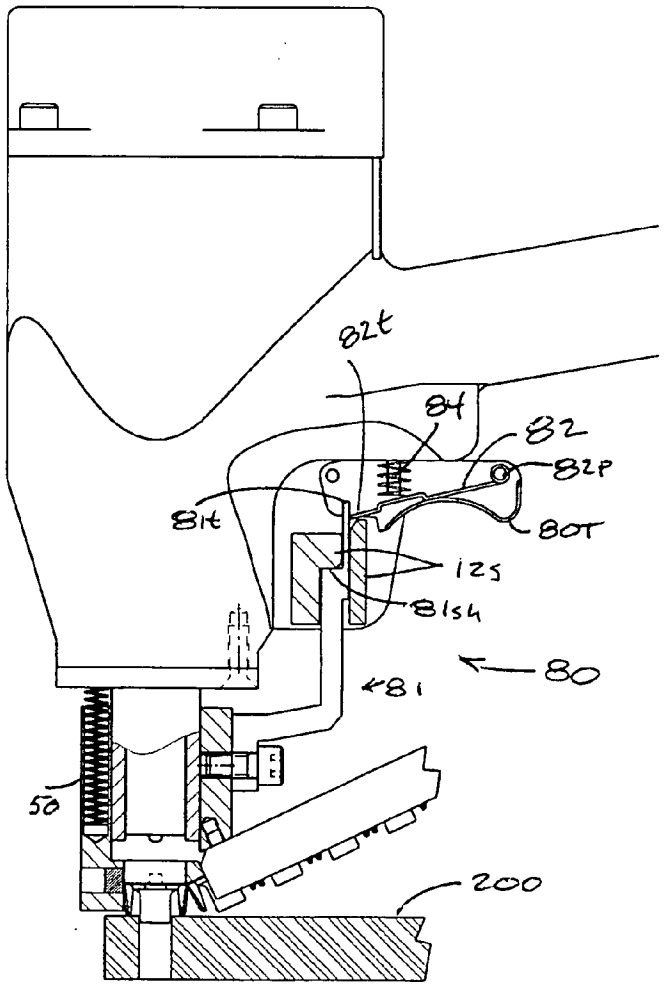
Figure 7F:
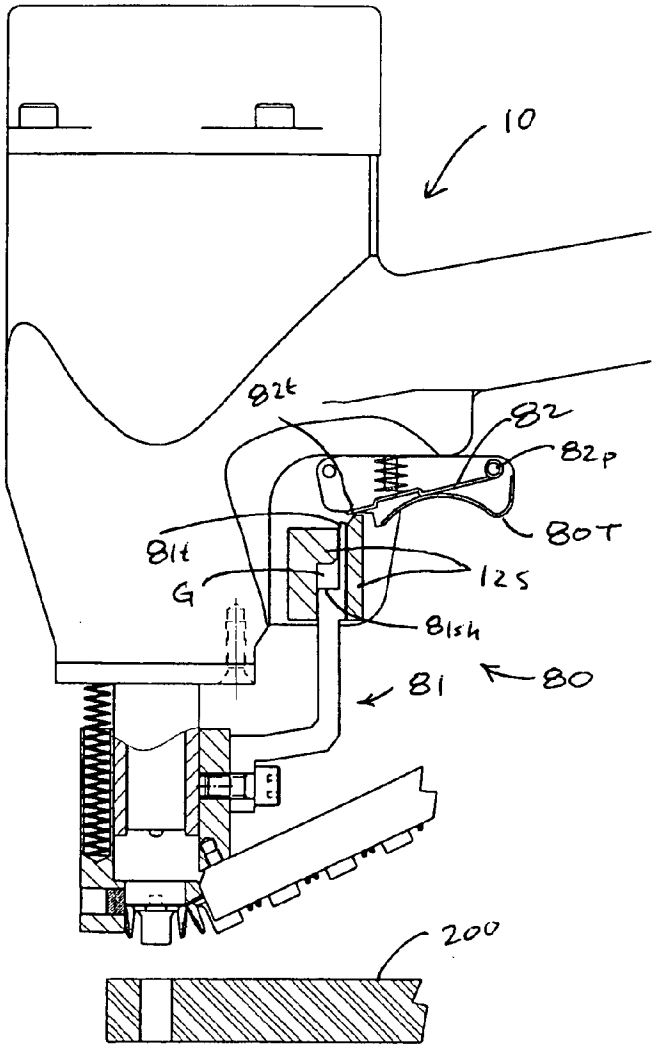

With reference to FIGS. 6(*a*) to 6(*h*), one embodiment of the nose piece 50 and safety actuator 81 are describe in further detail. In particular, FIGS. 6(*a*) to 6(*d*) include a perspective view, a side view, a bottom view, and a plan view, respectively, of nose piece 50. FIG. 6(*e*) is a sectional view taken along line 6E-6E of FIG. 6(*d*), and FIG. 6(*f*) is a sectional view taken along line 6F-6F of FIG. 6(*d*). Note particularly that when the t-nut 100 is in position in the nose piece 50, it is constrained by the slot 52 from moving upwardly by a roof 52*f* of the slot 52, or from moving laterally by side walls 52*a*, 52*b*, 52*c* of the slot 52. FIGS. 6(*a*) to 6(*f*) also show central bore 53, opening 53*o* at the bottom of central bore 53, one or more spring holes 54 for accommodating spring(s) 40, vertical slot 57, notch 50*n* for accommodating a front end 60*e* of the magazine 60, screw hole 55 for accommodating screw 60*s* and rigidly attaching the front end 60*e* of magazine 60 to the nose piece 50, bottom face 50*f* of the nose piece 50, recess 50*r* on a side face of the nose piece 50, and bores 56, 56*a*, and 56*b* for insertion of one or more magnets 50*m* into the nose piece 50.

FIGS. 6(*g*) and 6(*h*) provide a side and a perspective view of one embodiment the safety actuator 81. As can be seen, safety actuator 81 includes and upper tip 81*t*, an upward extending portion 81*s*, an upper shoulder 81*sh*, and a hole 81*h* for accommodating a fastener 81*f* (See FIGS. 7(*a*) and 7(*b*)) for mounting the safety actuator in a recess 50*r* on one side of the nose piece 50.

Referring to FIGS. 7(*a*) to 7(*g*), the pneumatic drive mechanism and safety mechanism of the hand tool 10 will be described. In particular, FIGS. 7(*a*) to 7(*e*) show a sequence of using the hand tool 10 for locating a hole 210 in the work piece 200 and inserting a t-nut 100 into the hole 210.

In FIG. 7(*a*), the hand tool 10 is in a rest position above the work piece 200, and there is a gap between the bottom end of the drive rod 20 and the flange 110 of the t-nut 100 that is positioned in the nose piece 50. Of course, prior to using hand tool 10, the operator loads a strip 150 of t-nuts 100 into the magazine 60 of the hand tool. The spring loaded follower (not shown) pushes on the distal end of the strip 150, bringing the first t-nut 100 into position in the nose piece 50. Magnets 50*m* holds the t-nut 100 in place in slot 52 (see FIGS. 6(*a*) to 6(*f*)). The barrel 130 of this t-nut 100 protrudes downward below the magazine 60 and the barrels of the other t-nuts 100 in the strip 150. In FIG. 5(*a*) tip of the barrel 130 of the t-nut is not yet inserted into the hole 210.

To insert a t-nut 100 into a work piece, the operator locates the t-nut 100 in the nose piece 50 into the hole, as shown in FIG. 7(*b*), and then presses down on the hand tool body, as shown in FIG. 7(*c*). This causes the magazine and nosepiece assembly to slide upward until the upper shoulder 81*sh* of the safety actuator 81 pushes up against a downward facing surface of sleeve 12*s* of the drive head. As upper shoulder 81*sh* of the safety actuator 81 pushes up against a downward facing surface of sleeve 12*s*, gap G shown in FIGS. 7(*a*) and (*b*) is closed. At the same time, an upper tip 81*t* of the safety actuator 81 pushes upward on a tip 82*t* of an actuator plate 82. The actuator plate 82 is made of a rigid material and is pivotably mounted at pivot point 82*p*. Sleeve 12*s* acts as a guide channel for the safety actuator 81, allowing smooth up and down movement, while preventing any lateral movement.

Next, as can be seen in FIG. 7(*d*), when the operator of the hand tool pulls trigger 80T, an actuator plate 82 pushes upward against the downward force of spring 83 and depresses valve stem 84, thereby activating a pulse of the drive mechanism, and driving a t-nut 100 into the work piece with a single blow. Note, that as shown in FIG. 7(*d*), the upper shoulder 81*sh* of the safety actuator 81 remains pushed up against a downward facing surface of sleeve 12*s* of the drive head as the trigger 80T is pulled.

FIG. 7(*d*) also shows the process of driving the prongs P1-P4 of the t-nut 100 into the work piece 200 breaks the tape 100T that connects t-nut 100 to the remaining t-nuts in the collated strip.

When the t-nut 100 has been completely driven into the work piece 200, the operator lifts the hand tool 10 off the work piece 200, the spring(s) 40 push the drive head 12 and the nose piece and magazine assembly apart. FIG. 7(*e*) illustrates the hand tool 10 having returned to this so-called rest position, as shown in FIG. 7(*a*). In the rest position, the nose piece 50 is in the down position, and the upper shoulder 81*sh* of the safety actuator 81 is separated from the downward facing surface of the sleeve 12*s* by gap G. When the nose piece 50 and magazine 60 are extended downward, the follower of the magazine 60 pushes the next t-nut 100 into position in the nose piece 50, and the hand tool 10 in ready to insert the next t-nut 100 into the next hole.

Next, with reference to FIGS. 7(*f*) and 7(*g*), the operation of the safety mechanism 80 will be described. The safety mechanism 80 allows the drive mechanism to be activated by the trigger 80T only when nose piece 50 is moved upward by applying downward pressure on hand tool 10. In particular, FIG. 7(*f*) shows pulling of the trigger 80T while the hand tool 10 is still above the work piece 200. In this instance, pulling the trigger 80T causes the trigger to rotate such that the forward tip 82*t* of the actuator plate 82 is no longer above upper tip 81*t*. Thus, the drive mechanism cannot be activated.

As shown in FIG. 7(*g*), hole 210 has been located by the t-nut 100, and downward pressure has been applied to the hand tool moving nose piece 50 upward. However, since trigger 80T was pulled prior to applying downward pressure on the hand tool, the upper tip 81*t* of the safety actuator 81 passes by the forward tip 82*t* of the actuator plate 82. Thus, the actuator plate 82 cannot depress valve stem 84 of the drive mechanism. In other words, in order to activate the drive mechanism, the operator must first apply firm downward pressure on the hand tool 10 to move the nose piece upward so that shoulder 81*sh* of the safety actuator 81 presses up against the downward face of sleeve 12*s*. Only then, will the safety mechanism be released, allowing operation of the trigger 80T to activate the drive mechanism.

The safety actuator 81 may be integrated with the nose piece 50, as shown, or may be provided by other means. Further, trigger safety mechanisms 80 other than the sequential style shown may be provided.

In some applications, foam may be injected around a wood or plastic work piece 200 after the t-nut 100 is inserted. In these cases, it is common for the flange 110 of the t-nut 100 to be covered with a tape in order to prevent foam from reaching the threads inside the t-nut 100. Since the pneumatic hand tool 10 for inserting t-nuts 100 of the present invention locates the hole 210 in the work piece 200 by actually placing the t-nut 100 in the hole 210, the need in conventional devices or machines for a separate device to carry the t-nut 100 from the track or magazine to the hole can be eliminated. For this reason, the drive rod 20 of the hand tool 10 of the present invention has only a small locating nib 20*n* (hemispherically-shaped), as opposed to the long guide pin, typically found in conventional devices. If a flexible tape 100T is used to collate the t-nut strips 150, the nib 20*n* does not pierce the tape 100T, leaving it intact on the flange 110 of the t-nut nut 100. This can eliminate the need for a secondary taping operation for applications involving injected foam.

Figure 8B:
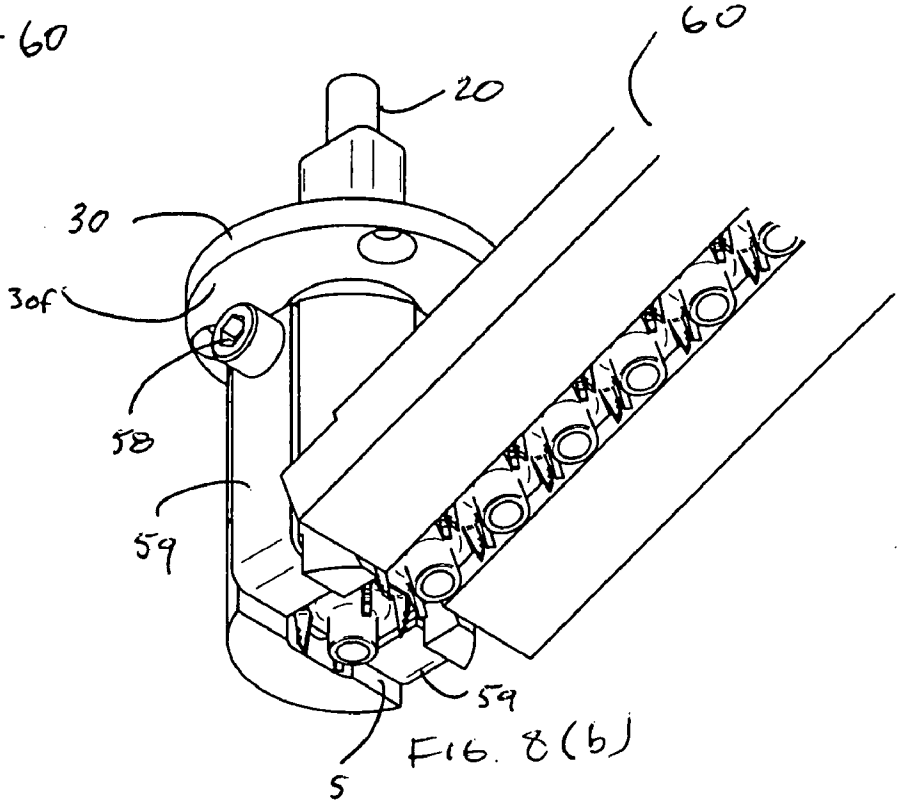
FIGS. 8(*a*) and 8(*b*) are 3-d views of the nose piece assembly of an alternative embodiment of the present invention.
Figure 8A:
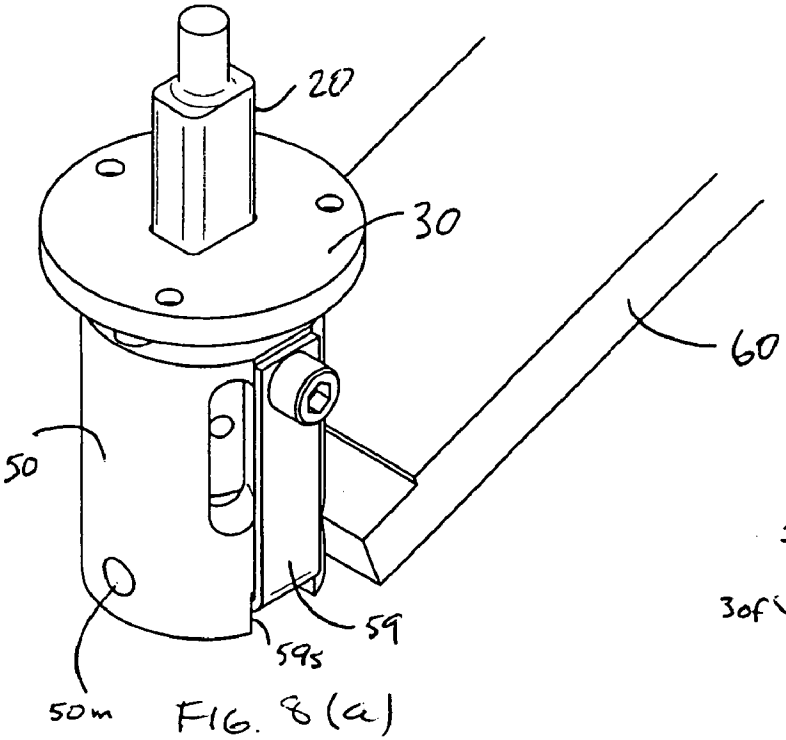
Figure 9C:
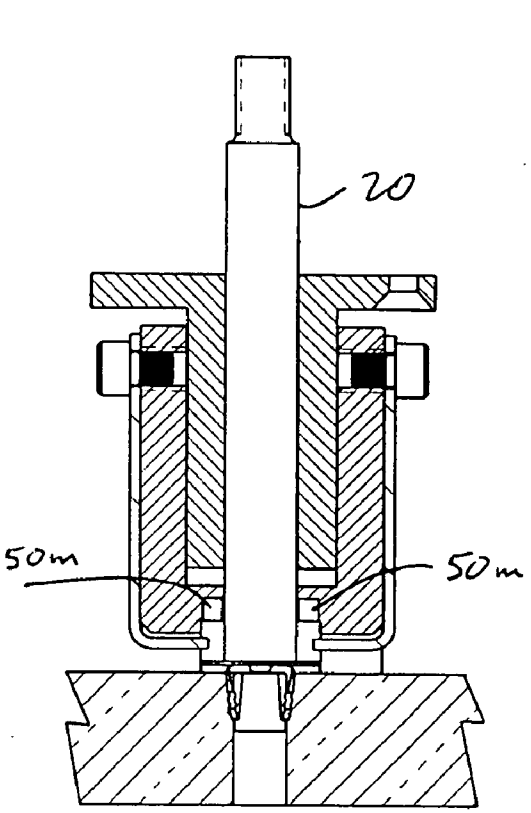
FIGS. 9(*a*) to 9(*c*) illustrate the functioning of the L-shaped fingers of the alternative embodiment shown in FIGS. 8(*a*) and 8(*b*)
Figure 9B:
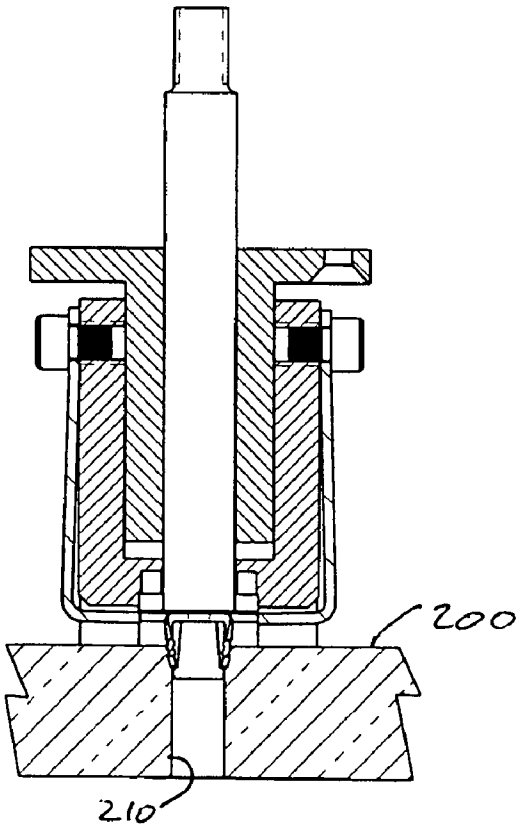
Figure 9A:
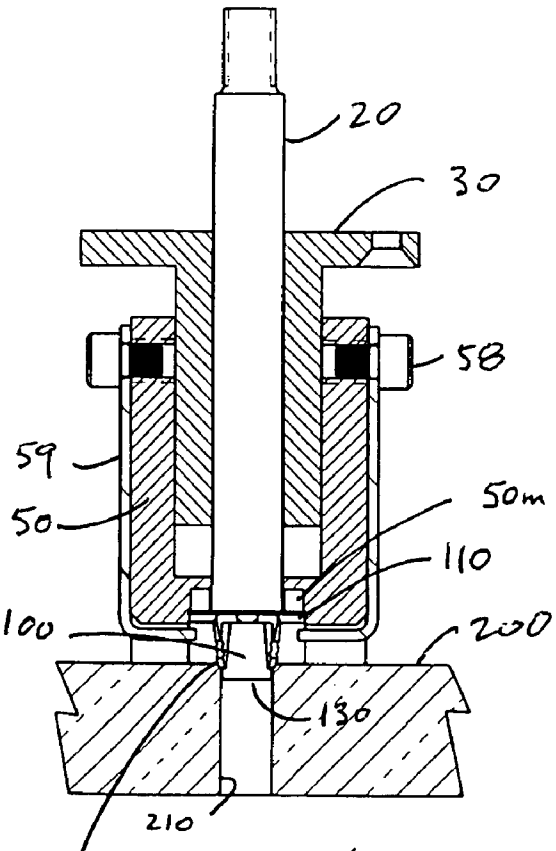

FIGS. 8(*a*) and 8(*b*), and FIGS. 9(*a*) to 9(*c*), are exemplary illustrations of an alternative embodiment of the present invention. FIGS. 8(*a*) and 8(*b*) are 3-d views of the nose piece assembly of the alternative embodiment from the exterior. Whereas the embodiments described above used one or more magnets 50*m* to retain the t-nuts 100 in the nose piece 50, this alternative embodiment employs L-shaped fingers 59 attached to the nose piece 50 and extending into slots 59*s* so as to retain the t-nut 100 in the nose piece 50. Alternatively, one or more magnet 50*m* may also be used in conjunction with the L-shaped fingers 59. The L-shaped fingers 59 in this embodiment may be made of flexible spring strips, such as a flexible steel material, or other flexible material, and may be attached to the nose piece 50 by means of fasteners 58.

FIGS. 9(*a*) to 9(*c*) illustrate the functioning of the L-shaped fingers 59 showing the cutaway drawings of the nose piece 50 during three successive stages of insertion.

FIG. 9(*a*) illustrates the t-nut barrel 130 (slightly inserted into the hole 210) prior to insertion of the prongs P1-P4 into the work piece 200. The L-shaped fingers 59 can be seen retaining the flange 110 of the t-nut 100 in the nose piece 50.

FIG. 9(*b*) illustrates shows the t-nut 100 is being pushed past the L-shaped fingers 59, the fingers being forced open to allow the flanges 110 of the t-nut 100 to pass.

In FIG. 9(*c*) the insertion of t-nut 100 is complete. The t-nut 100 is fully inserted into the work piece 200, and the drive rod 20 in a fully extended position.

Next, referring to FIGS. 10(*a*) to 10(*b*), and 11(*a*) to 11(*e*), additional features of the invention will be described. These FIGS. illustrate exemplary means for (1) adjusting the stoke of the nose piece/magazine assembly, and for (2) adapting the tool to accommodate t-nuts having barrels of different lengths.

Figure 10B:
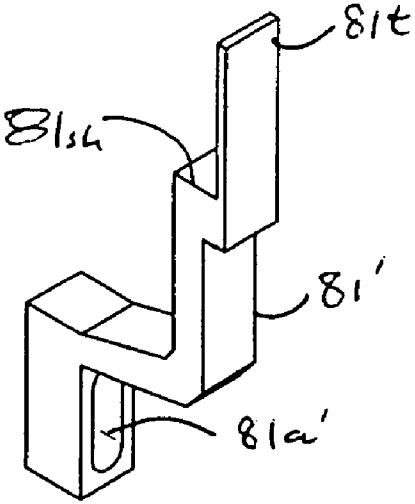
FIGS. 10(*a*) and 10(*b*) illustrate an alternative embodiment of a safety actuator.
Figure 10A:
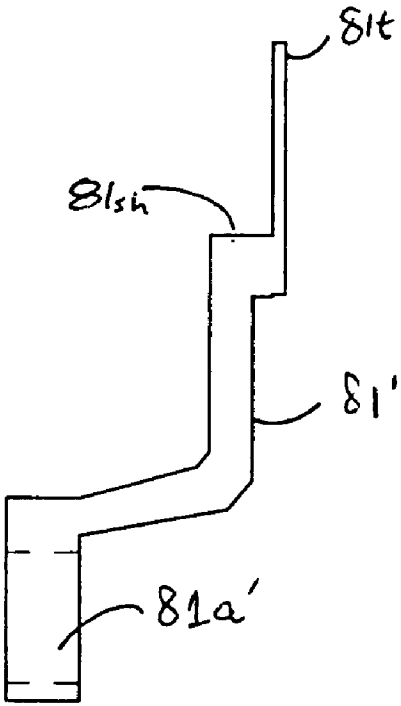

FIGS. 10(*a*) and 10(*b*) provide two view of an alternative embodiment of a safety actuator 81'. Safety actuator 81' differs from safety actuator 81 shown in FIGS. 6(*g*) and 6(*h*), in that it is formed with a slot 81*a*', instead of a hole. Other aspects of safety actuator 81' are the same as safety actuator 81, so are not repeated here.

Slot 81*a*' enables the safety actuator 81' to be mounted at different positions along the side of nose piece 50. The adjustable safety actuator may be used to control the depth to which the t-nut 100 is driven (for example, if the user would like the upper surface of the flange 110 of the t-nut 100 driven flush with the work piece 200, or to have the flange 110 remain above the surface of the work piece 200), and also to configure the hand tool 10 to work with t-nuts 100 having barrels 130 with different lengths. Conmmon t-nuts have barrel lengths in the range of ¼" to ⅝". However, the hand tool 10 of the present invention may be configured to accommodate t-nuts with barrel lengths in the range of 3⁄16" to ⅞", or lengths outside this range.

Figure 11B:
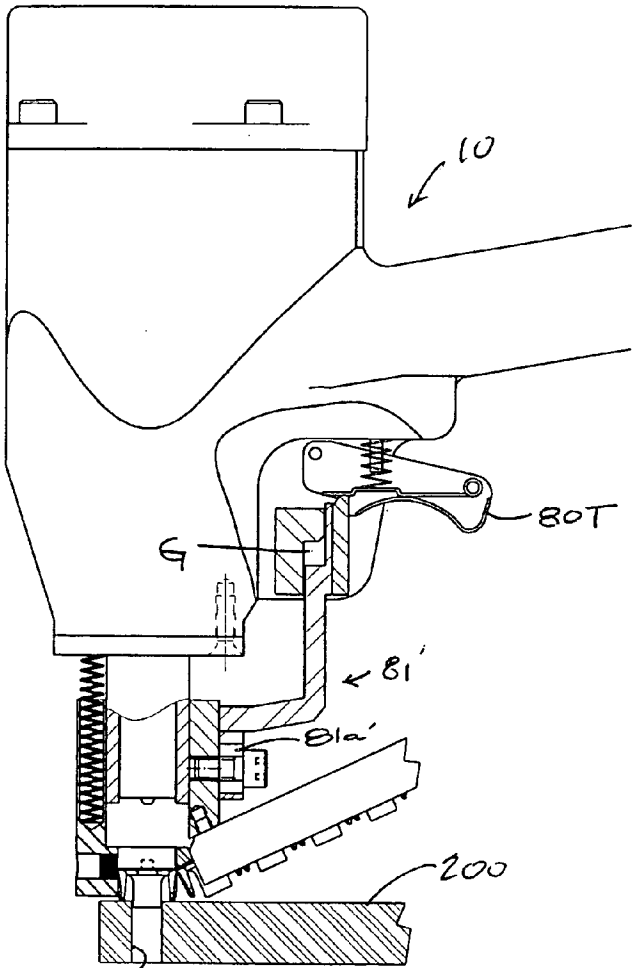
FIGS. 11(*a*) to 11(*e*) are cutaway views (similar to FIGS. 7(*a*) to 7(*e*)) showing an exemplary sequence of locating a hole and inserting a t-nut with a nose piece assembly equipped with the alternative embodiment of the safety actuator as shown in FIGS. 10(*a*) and 10(*b*)
Figure 11A:
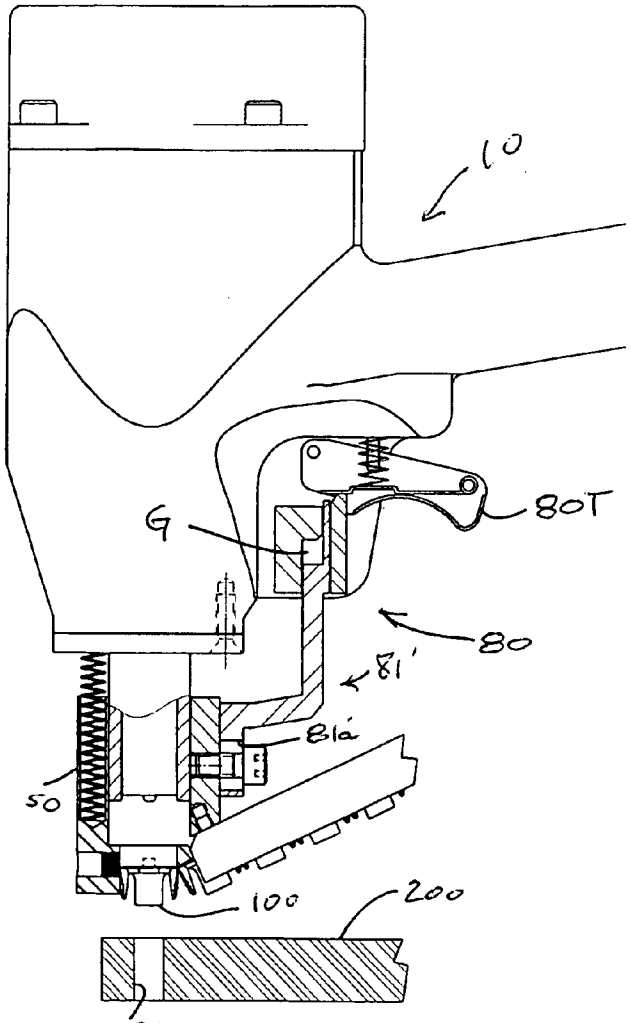
Figure 11D:
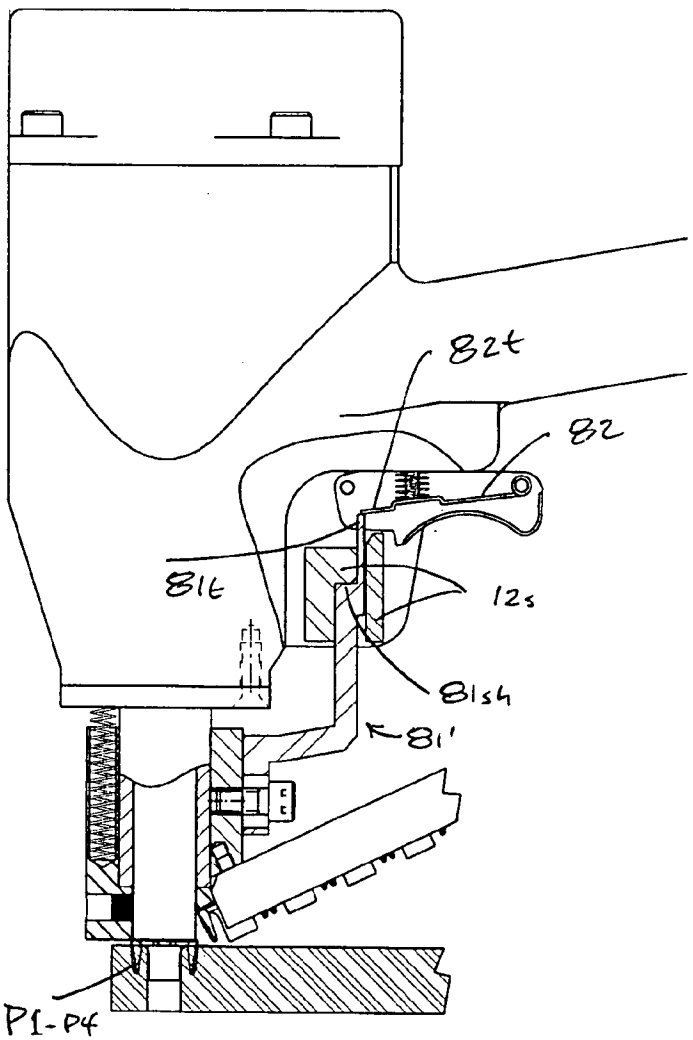
Figure 11C:
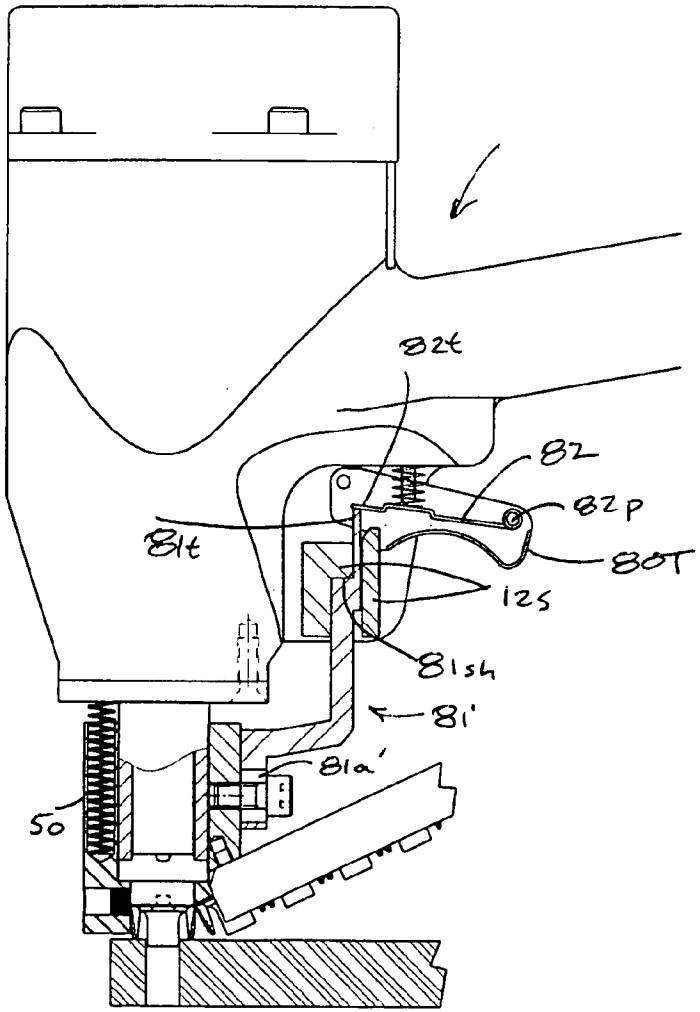
Figure 11:
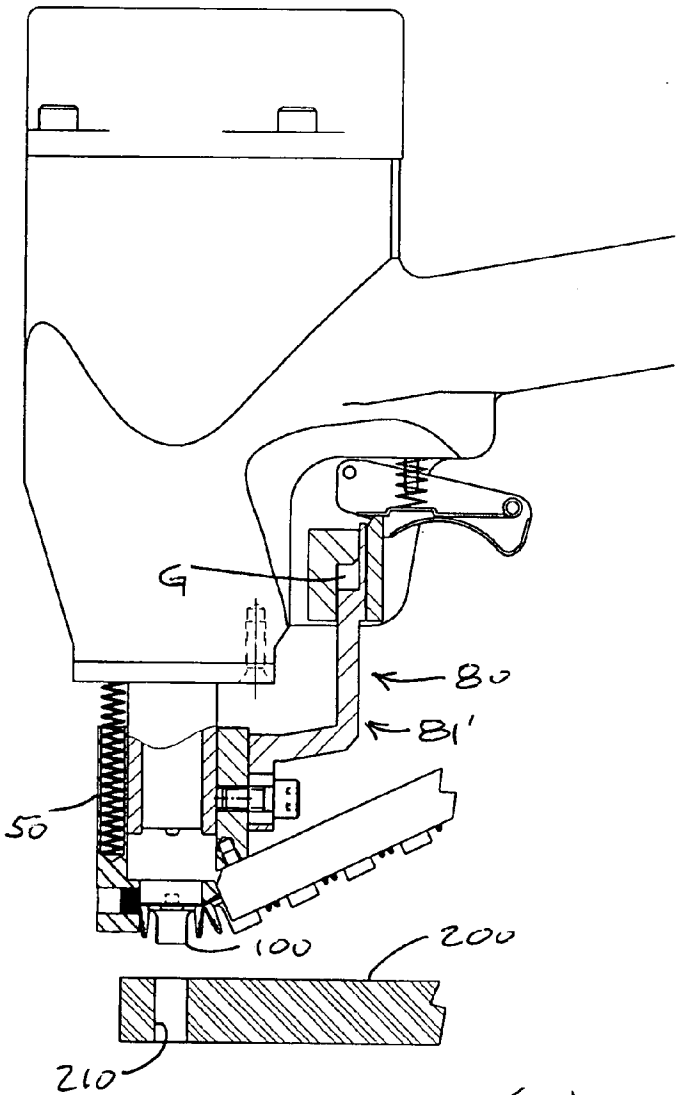

FIGS. 11(*a*) to 11(*e*) are cutaway views (similar to FIGS. 7(*a*) to 7(*e*)) showing an exemplary sequence of locating a hole 210 and inserting a t-nut 100 with a hand tool 10 having nose piece assembly equipped with the alternative embodiment of the safety actuator 81', as shown in FIGS. 10(*a*) and 10(*b*). Operation of hand tool 10 shown in FIGS. 11(*a*) to 11(*e*) is the same the operation of hand tool 10 shown in FIGS. 7(*a*) to 7(*e*), so is not repeated here.

Figure 12A:
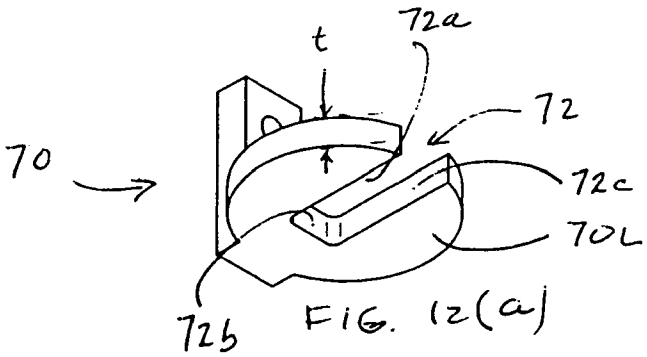
FIG. 12(*a*) is a perspective view of an exemplary nose piece extender element, and FIGS. 12(*b*) and 12(*c*) are perspective views of the nose piece assembly with the nose piece extender attached thereto consistent with some embodiments of the present invention.
Figure 12C:
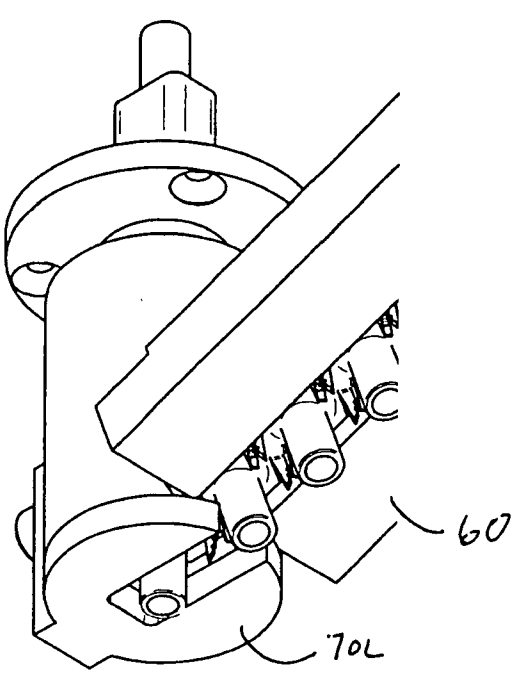
Figure 12B:
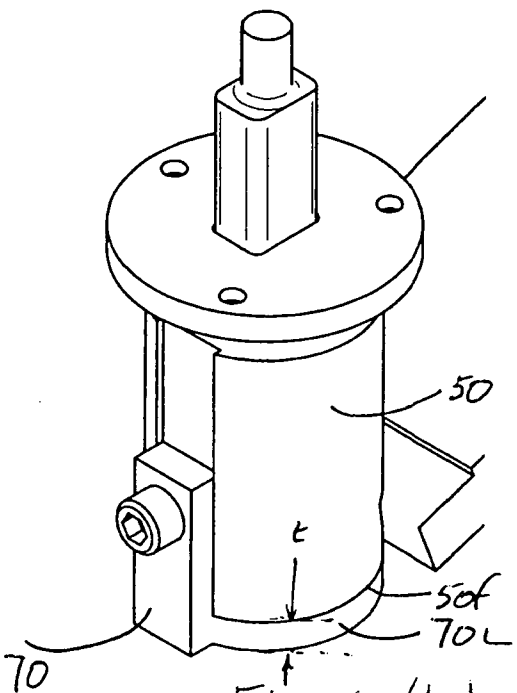

FIGS. 12(*a*), 12(*b*), and 12(*c*) illustrate still another embodiment of the present invention. In particular, FIG. 12(*a*) provides a perspective view of an exemplary nose piece extender 70, and FIGS. 12(*b*) and 12(*c*) are perspective views of the nose piece assembly with the nose piece extender 70 attached thereto. As can be seen, the nose piece extender 70 has a lower portion 70L which extends under the lower face 50*f* of the nose piece 50. As such, the nose piece extender 70 extends the length of the nose piece 50, enabling the nose piece 50 to accommodate t-nuts having barrels 130 of different lengths. The lower portion 70L of the nose piece extender is formed a slot 72, the slot 72 having sides walls 72*a*, 72*b*, and 72*c*. Slot 72 of the nose piece extender 70 has lateral dimensions substantially equal to those of slot 52 of the nose piece 50. The lower portion 70L has a predetermined thickness t, the thickness t being set to accommodate t-nuts 100 having barrels 130 of different lengths.

Figure 13B:
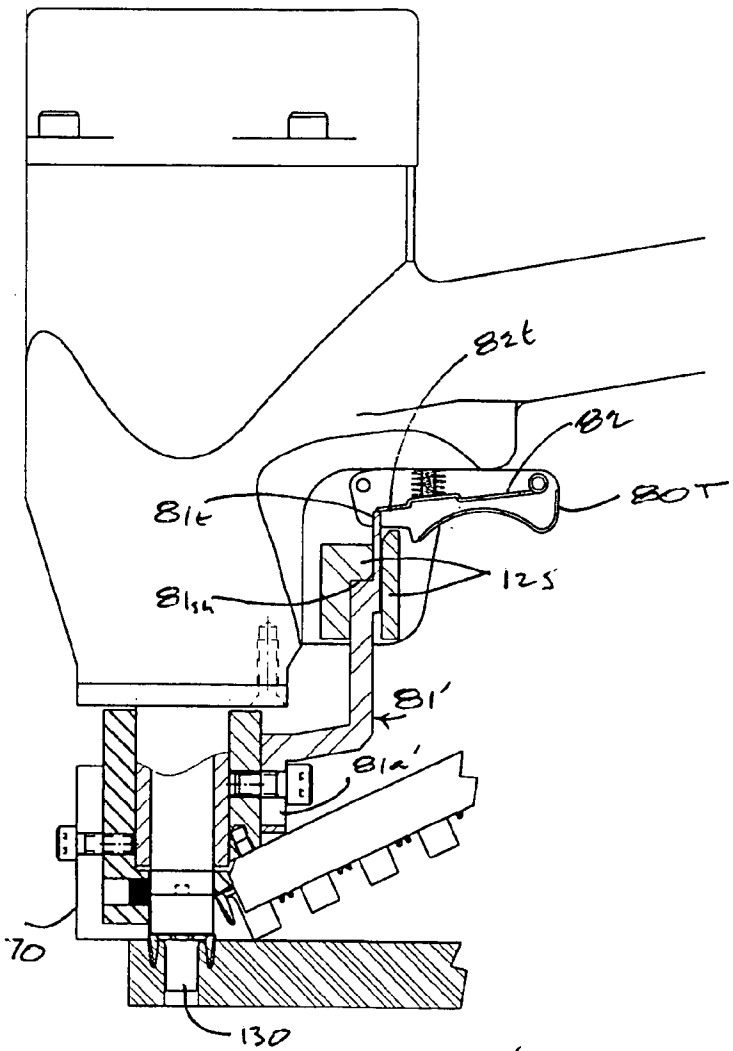
FIGS. 13(*a*) and 13(*b*) are cutaway views (similar to FIGS. 7(*c*) and 7(*d*)) showing and exemplary sequence of locating a hole and inserting a t-nut with a long barrel using the nose piece assembly equipped with the lower contact element as shown in FIGS. 12(*a*) to 12(*c*).
Figure 13A:
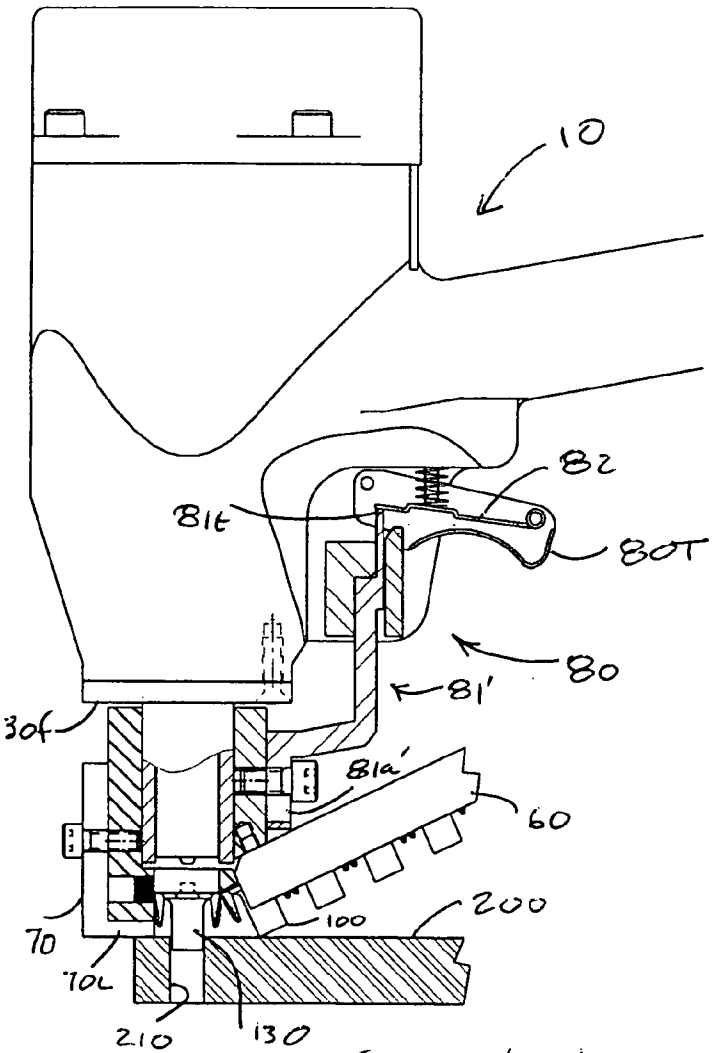

FIGS. 13(*a*) and 13(*b*) are cutaway views (similar to FIGS. 7(*c*) and 7(*d*)) showing and exemplary sequence of locating a hole and inserting a t-nut having a longer barrel 130 using the nose piece 50 equipped with the nose piece extender 70, as shown in FIGS. 12(*a*) to 12(*c*).

As can be seen in FIG. 13(*a*), the safety actuator 81' having slot 81*a*' is positioned on the nose piece 50 so that tip 81*t* extends the least amount above the nose piece 50. This means that in order to activate the hand tool, the operator must depress the hand tool further before the shoulder 81*sh* of the safety actuator 81' contacts the downward facing surface of sleeve 12*s*. In other words, the gap between the nose piece 50 and flange 30*f* is small, since the operator has already depressed to hand tool and is ready to pull the trigger 80T to drive the t-nut 100 into the hole 210. FIG. 13(*a*) shows the lower face 70*f* of the lower portion 70L of the nose piece extender 70 being flush with the lowest part of the first t-nut 100 in the magazine 60 (not the t-nut 100 in the nose piece 50). When the operator locates the hole 210 in the work piece 200 with the end of the barrel 130 of the t-nut 100 and presses down on the hand tool 10, the pressure is applied to the nose piece extender 70, and not the t-nut 100 in the magazine 60. In FIG. 13(*b*), the trigger 80T is then pulled, and the t-nut 100 is driven into the workpiece 200.

Additional alternative embodiments may include one or more of the following features.

The pneumatic hand tool of the present invention may be adapted to accommodate a wide variety of t-nuts, including t-nuts having different base widths and barrel lengths, and t-nuts with and without prongs. Also, t-nuts with any number of prongs may be accommodated. Further, the front end 60*e* of magazine 60 may be attached to the nose piece 50 by means other than screw 60*s*. In addition, magazines and t-nut feeding devices of various sizes and shapes may be attached to the nose piece 50. These magazines and t-nut feeding devices may accomodate strips of 15, 20, 50 or 100, or more t-nuts, depending on the base size of the t-nut and the particular magazine or t-nut feeding device used. Still further, while three springs 40 are shown in the nose piece 50, one, two, or four springs may be used instead.

Also, while slot 57 and screw 50*s* are used for limiting the up and down movement of the nose piece 50, other mechanisms may be used. Further, the L-shaped fingers 59 may be used with either of the safety actuators 81 and 81'.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A portable device for inserting fixing elements into predefined seats in a work piece, the portable device comprising:

a drive head;

a drive rod extending downward from the drive head;

a hollow nose piece slidably fit around a lower end of the drive rod, the nose piece being attached to the drive head and being movable vertically by a predetermined distance with respect to the drive head and the drive rod;

a magazine mounted on the nose piece at a predetermined angle with respect to a lower face of the nose piece for feeding a first fixing element into a horizontal slot on the lower face the nose piece; and a single-blow drive mechanism providing a force produced by a pressurized fluid to an upper end of the drive rod, wherein the force on the drive rod drives the first fixing element into the predefined seat in the work piece, wherein the horizontal slot on the face of the nose piece has a depth in the vertical direction that is made to be less than lengths of the fixing elements so that lower ends of the fixing elements in the slot project below the lower face of the nose piece, the lower ends of the fastening elements enabling a user of the portable device to locate successive ones of the predefined seats into which the fixing elements are to be inserted.

2. The portable device for inserting fixing elements according to claim 1, wherein the slot of the nose piece is arranged such that the first fixing element is disposed under a lower face of the drive rod and such that a part of the fixing element in the slot projects below the lower face of the nose piece, the projecting part of the first fixing element for locating one of the predefined seats into which the first fixing element is to be inserted.

3. The portable device for inserting fixing elements according to claim 1, further comprising an extension tube fixed to a lower side of the drive head, the nose piece being movable vertically with respect to the extension tube and the drive rod by the predetermined distance.

4. The portable device for inserting fixing elements according to claim 3, wherein the nose piece is provided with a vertical slot on a side thereof, and a screw fastened to the extension tube and extending through the vertical slot of the nose piece prevents the nose piece from moving beyond the predetermined distance.

5. The portable device for inserting fixing elements according to claim 1, further comprising a spring to bias the nose piece away from the drive head when upward pressure is not applied to the nose piece.

6. The portable device for inserting fixing elements according to claim 5, after the nose piece receives an upward pressure from an area of the work piece around the seating, thus causing the nose piece to move upward toward the drive head, the drive rod is adapted to drive the first fixing element into the predefined seat.

7. The portable device for inserting fixing elements according to claim 1, wherein the magazine is attached to the nose piece and the hand grip at an angle with respect to a horizontal, so that a barrel of the first fixing element extends further downward than barrels of the fixing elements remaining in the magazine.

8. The portable device for inserting fixing elements according to claim 7, wherein the magazine moves up and down together with the nose piece.

9. The portable device for inserting fixing elements according to claim 1, wherein the magazine is adapted to receive a collated strip of the fixing elements.

10. The portable device for inserting fixing elements according to claim 9, wherein the magazine includes a follower that is adapted to advance the fixing elements one-at-a-time into the horizontal slot on the lower face of the nose piece, each successive fixing element advancing after the preceding fixing element is driven into the predefined seat and the portable device is lifted away from the work piece.

11. The portable device for inserting fixing elements according to claim 1, wherein the nose piece is provided with at least one magnet for holding the first fixing element in the horizontal slot.

12. The portable device for inserting fixing elements according to claim 1, wherein the nose piece is provided with fingers for holding the first fixing element in the horizontal slot.

13. The portable device for inserting fixing elements according to claim 1, wherein the horizontal slot prevents the fixing elements from moving or rotating laterally.

14. The portable device for inserting fixing elements according to claim 1, further comprising an extension tube extending downward from the drive head, the nose piece being slidably fit around a lower portion of the extension tube, means for adjusting a stroke of the nose piece, the means for adjusting the stroke of the nose piece including:

a vertical slot cut through a side of the nose piece, a screw projecting into the vertical slot from a side wall of the extension tube, wherein the nose piece is capable of sliding up and down along the extension tube only over a length of the vertical slot.

15. The portable device for inserting fixing elements according to claim 1, further comprising means for accommodating different fixing element barrel lengths.

16. The portable device for inserting fixing elements according to claim 1, further comprising a trigger for activating the single-blow drive mechanism causing the pressurized fluid to drive the drive rod against the first fixing element.

17. The portable device for inserting fixing elements according to claim 16, further comprising a trigger safety mechanism having a safety actuator attached to the nose piece.

18. The portable device for inserting fixing elements according to claim 17, wherein the safety actuator is adapted to prevent the trigger from activating the single-blow drive mechanism unless the nose piece has been moved upward against an extension tube attached to the drive head.

19. The portable device for inserting fixing elements according to claim 17, wherein the safety actuator includes means for accommodating different fixing element barrel lengths.

20. The portable device for inserting fixing elements according to claim 1, further comprising a hollow extension tube which is fixed to a bottom face of the drive head, the drive rod being adapted to move up and down through an entire length of the hollow extension tube, and the nose piece being adapted to slidably fit around an outer circumferential surface of the hollow extension tube.

21. A portable device for inserting fixing elements into predefined seats in a work piece, the portable device comprising:

a single-blow drive mechanism in a head;

a drive rod extending downward from the drive mechanism;

a hollow, cylindrical-shaped nose piece slidably fit around a lower end of the drive rod, the nose piece being attached to the head and being movable vertically, with respect to the head and with respect to the drive rod, between a down position and an up position;

a magazine for sequentially feeding a first fixing elements into a horizontal slot on a lower face the nose piece, the slot of the nose piece being arranged such that the fixing element is disposed under a lower face of the drive rod;

and when the first fixing element at the lower end of the drive rod presses against the work piece and when the drive mechanism in the head is triggered, a force produced by a pressurized fluid to an upper end of the drive rod, and the force on the drive rod drives the first fixing element into the predefined seat in the work piece, wherein the horizontal slot on the face of the nose piece has a depth in the vertical direction that is made to be less than lengths of the fixing elements so that lower ends of the fixing elements in the slot project below the lower face of the nose piece, the lower ends of the fastening elements enabling a user of the portable device to locate successive ones of the predefined seats into which the fixing elements are to be inserted.

22. The portable device for inserting fixing elements according to claim 21, further comprising a trigger safety mechanism, the safety mechanism allowing the force of the pressurized fluid to be applied to the drive rod only when the nose piece is moved to a position against the head.

* * * * *